US005526108A

United States Patent [19]

Billet et al.

[11] Patent Number: 5,526,108

[45] Date of Patent: Jun. 11, 1996

[54] ELECTROSTATOGRAPHIC PRINTER WITH IMAGE-FIXING STATION

[75] Inventors: Patrick Billet, Jette; Jan J. I. De Bock, Beveren; Etienne M. De Cock; Lucien A. De Schamphelaere, both of Edegem; Louis Luyckx, St-Katelijne-Waver; Erik G. G. Van Weverberg, Mortsel, all of Belgium

[73] Assignee: Xeikon NV, Mortsel, Belgium

[21] Appl. No.: 257,633

[22] Filed: Jun. 8, 1994

[30] Foreign Application Priority Data

Jun. 18, 1993 [EP] European Pat. Off. ..... 93304768

[51] Int. Cl.[6] ..... G03G 15/00

[52] U.S. Cl. ..... 355/326 R; 101/177; 355/282

[58] Field of Search ..... 355/326 R, 327, 355/328, 282, 285–288, 271, 274, 277; 219/216; 101/177, 180, 248; 271/194, 196, 197

[56] References Cited

U.S. PATENT DOCUMENTS

| | | | |
|---|---|---|---|
| 3,449,546 | 6/1969 | Dhoble | 219/216 |
| 3,748,088 | 7/1973 | Mooney et al. | 432/46 |
| 3,775,102 | 11/1973 | Punnett | 96/1 |
| 3,922,520 | 11/1975 | Moore | 219/216 |
| 4,019,054 | 4/1977 | Saito et al. | 250/319 |
| 4,075,455 | 2/1978 | Kitamura et al. | 219/216 |
| 4,160,595 | 7/1979 | Ito et al. | 355/282 |
| 4,355,225 | 10/1982 | Marsh | 219/216 |
| 4,367,037 | 1/1983 | Nishikawa | 355/282 |
| 4,768,057 | 8/1988 | Kumada et al. | 355/288 |
| 5,068,684 | 11/1991 | Abe et al. | 355/27 |
| 5,147,745 | 9/1992 | Russel | 430/49 |
| 5,274,428 | 12/1993 | Wong et al. | 355/326 R |
| 5,331,890 | 7/1994 | Miyoshi et al. | 101/177 |

FOREIGN PATENT DOCUMENTS

| | | |
|---|---|---|
| 0363686 | 9/1989 | European Pat. Off. . |
| 2250614 | 4/1974 | Germany . |
| 2506953 | 8/1975 | Germany . |
| 2532253 | 2/1976 | Germany . |
| 62-38490 | 2/1987 | Japan . |
| 62-055685 | 3/1987 | Japan . |
| 63-161471 | 7/1988 | Japan . |
| 1449018 | 9/1976 | United Kingdom . |
| 1590872 | 6/1981 | United Kingdom . |

*Primary Examiner*—A. T. Grimley
*Assistant Examiner*—Thu Dang
*Attorney, Agent, or Firm*—Brumbaugh, Graves, Donohue & Raymond

[57] ABSTRACT

An electrostatographic printer includes an imaging station for forming a latent electrostatic image on the surface of a drum, a toner development station for developing the latent image to form a toner image, and a toner transfer station for transferring the toner image onto a moving web. An image-fixing station for fixing the toner image on the web includes two pairs of radiant heat sources, the peak energy output wavelength of which lies in the non-visible part of the spectrum. The radiant sources may be located in hingedly mounted pairs of housings in such a manner that the housings may be moved into a closed position to shield the radiant sources from the web when the speed of movement of the web falls below a predetermined value. Thus, damage to the web when movement of the web stops is avoided.

15 Claims, 10 Drawing Sheets

ELECTROSTATOGRAPHIC PRINTER WITH IMAGE-FIXING STATION

FIELD OF THE INVENTION

This invention is concerned with an electrostatographic printer. More particularly, it is concerned with the fixing of toner images obtained via electrophotographic, electrographic, ionographic or magnetic recording processes in which an electrostatic or magnetographic latent image is rendered visible by the deposition of an suitable toner composition on the latent image.

BACKGROUND TO THE INVENTION

In present day copying machines or electronic printer devices, the fixing or permanent adherence of a toner image on a receptor material in the form of a sheet is mostly carried out with a so-called roller fixing system. This image-fixing unit comprises a pair of rollers through the nip of which a sheet carrying a toner image is fed. The surface of the roller contacting the toner image is heated above the melting temperature of the toner resin, which becomes tacky or molten and forms a permanent bond with the surface of the sheet. The roller, contacting the toner image, is provided with a coating showing abhesive properties versus the toner image. In order to increase the abhesive characteristics of the roller surface, use is often made of silicone oil. The rollers forming the image-fixing unit are pressed against each other with high force. The roller contacting the backside of the web is generally covered with a silicone elastomer, capable of resisting the heat generated by the image-fixing roller.

Problems arise with hot roller image-fixing devices. In particular, in heavy duty printers where long periods between servicing are usual, it is difficult to maintain a constant image-fixing quality.

Where the receptor material is in the form of a continuous web, there is a need to synchronise the drive to the image-fixing rollers to the movement of the receptor material therethrough, but this may be difficult where the surface of one or both of the rollers is resilient, leading to uncertainty in its circumferential speed. There is a need to accurately align the image-fixing rollers, otherwise damaging skewing forces on the web may result. Roller image-fixing systems, due to the high pressure exerted in the nip formed by the rollers, also can be the cause of the toner image being smeared, especially in colour work. A second effect is that the high pressure gives rise to a fixed image showing an increased, and often unwanted, gloss. This degrading or "calendering" effect may even be transmitted to the receptor material itself so that its surface structure may wholly or partially be lost. Furthermore, damage to the receptor material, and to the image thereon, may occur if the receptor material is in contact with the heated roller for too long a period of time, such as if the movement of the receptor material were to stop for whatever reason.

Furthermore, hot roller fixing is not easily compatible with double-sided (ie, duplex) printing.

A technique known as "flash-fixing" is also known in which a short intense burst of radiant energy is applied to the receptor material carrying the toner image to be fixed. The wavelength of the radiant energy is chosen to be absorbed by the toner and is therefore in the visible or ultra-violet part of the spectrum. Such a technique is unsuitable for multi-colour images, where toners of different composition are carried on the receptor material, said toners having different adsorption characteristics in the visible spectrum.

A number of constructions of image fixing stations have been proposed in the art. Thus, British patent GB 1590872 (Xerox Corporation) describes an electrostatographic printer in which, after the transfer of toner images to a paper web, the images are fixed by radiant infra-red heaters. U.S. patent U.S. Pat. No. 3,449,546 (Dhoble/Xerox Corporation) describes a xerographic fusing apparatus, which is capable of heating toner powder to its melting point without damaging the paper support material, wherein the paper acts as a heat source to aid in the fusing process. German Offenlegungsschrift DE-A-2506953 (Itek Corp.) describes a fusing apparatus in the form of a hinged two-part housing, having open and closed positions, one part containing an active heat source and the other part containing a passive heat source which is heated by the active heat source in the closed position. This arrangement has the disadvantage that once the housing is in its open position, the indirect heat source loses-its heat, with the result that the heat output of the apparatus as a whole is not constant.

Where the fusing apparatus is used to fix toner on a moving web, especially when that web is formed of paper, a dangerous situation can arise in the event of a failure of the web drive, such as may occur if there is an electrical power failure. Even if electrical power to the fusing apparatus is cut at this time, a portion of the web stands in close proximity to the fusing apparatus which may retain significant heat for some time. There is therefore a risk that the web material will be damaged or may even catch fire. To the best of our knowledge, the prior art has not addressed this particular problem.

It is an object of the invention to provide an electrostatographic printer which avoids one or more of the aforementioned problems.

SUMMARY OF THE INVENTION

According to a first aspect of the invention there is provided an electrostatographic printer including:

(a) means for moving a web of receptor material along a web path;

(b) an imaging station comprising means for forming a toner developable latent image on surface member;

(c) a toner development station containing means for developing the latent image to form a toner image on the surface member;

(d) a toner transfer station positioned adjacent the web path comprising means for transferring the toner image from the surface member onto the moving web; and (e) an image-fixing station for fixing the toner image on the web, the image-fixing station being positioned adjacent and spaced from the web path downstream of the toner transfer station and including heating means comprising at least one radiant source, the peak energy output wavelength of which lies in the non-visible part of the spectrum, wherein said heating means is in the form of at least two hingedly coupled heat-shielding housings within at least one of which radiant sources are located and said housings are movable between an open position in which said web is exposed to the radiant sources, to fix a toner image on said web, and a closed position in which said radiant sources are shielded by said heat-shielding housings from said web, said printer further comprising sensing means for sensing movement of said web and automatic control means to initiate the shielding of said radiant source from said web when the speed of movement of said web falls below a predetermined value.

By providing heat-shielding housings to shield the radiant sources from the web in the closed position, that is to thermally isolate the sources therefrom, the problems referred to above, associated with the prior art devices, can be avoided.

According to a second aspect of the invention, there is provided a method of operating an electrostatographic printer including the steps of:

(a) moving a web of receptor material along a web path;

(b) forming a toner developable latent image on a surface member at an imaging station;

(c) developing the latent image to form a toner image on the surface member at a toner development station;

(d) transferring the toner image from the surface member onto the moving web at a toner transfer station positioned adjacent the web path;

(e) fixing the toner image on the web at an image-fixing station positioned adjacent and spaced from the web path downstream of the toner transfer station, the image-fixing station including heating means comprising at least one radiant source, the peak energy output wavelength of which lies in the non-visible part of the spectrum, wherein said heating means is in the form of at least two hingedly coupled heat-shielding housings within which radiant sources are located and said housings are movable between an open position in which said web is exposed to the radiant sources, to fix a toner image on said web, and a closed position in which said radiant sources are shielded by said heat-shielding housings from said web; and (f) sensing movement of said web and automatically initiating the shielding of said radiant source from said web when the speed of movement of said web falls below a predetermined value.

We prefer that the peak energy output wavelength of the radiant source corresponds to an absorption wavelength of the receptor material, which in preferred embodiments of the invention comprises paper, which absorbs radiation strongly (ie absorbs more than 50% incident energy) over the range of 3 μm to at least 8 μm. Thereby, the toner particles are heated indirectly, from the heat energy absorbed by the receptor material, the heat energy being transferred from the receptor material by a combination of conduction and convection. Some heat energy will, of course, be absorbed directly by the toner particles, to a degree depending upon their composition. Thus, the radiant source may comprise one or more infrared emitting sources, causing the receptor material to be heated above the melting temperature of the toner particles, so that the latter melt and adhere thereto. Due to the fact that heating occurs without contact with the receptor material, calendering effects are avoided. The radiant source preferably has a radiant energy output wavelength within the range of from 1 to 10 μm, such as within the range of from 3 to 6 μm.

The radiant heat sources may be provided along a relatively long trajectory of the receptor material, so that less restriction is placed upon the speed of the latter. Furthermore, smearing of the transferred toner image is also avoided. The infrared emitting radiant sources are preferably such as emit heat by the Joule-effect.

The image-fixing unit can be used to advantage in so-called duplex printing, where a toner image is present on both sides of the receptor material. In that case radiant sources are located at opposite sides of the web path. Thus the receptor material passes in between the radiant sources.

The image-fixing station thereby includes means for shielding the radiant source from the web when the speed of movement of the web falls below a predetermined value. This is achieved according to the invention in that the heating means is in the form of at least two hingedly coupled heat-shielding housings within which radiant sources are located and the housings are movable between an open position in which the web is exposed to the radiant sources, to fix a toner image on the web, and a closed position in which the radiant sources are shielded by the heat-shielding housings from the web.

The means for moving the housings from the closed to the open positions may be provided in the form of a cable connected between the housings and a cable drive device, operation of the cable drive device moving the housings into the open position for fixing of the image on the receptor material. The printer is provided with sensing means for sensing movement of the web and automatic control means to initiate the shielding of the radiant source from the web when movement of the web stops. The invention thus enables a safety feature to be included, whereby in the event of sudden loss of web speed, the radiant sources are rapidly and automatically shielded from the web. This can be achieved, for example, by arranging that the housings are capable of moving into the closed position under the force of gravity.

According to one embodiment of the invention, the printer includes means to control the output power profile of the heating means, in particular to achieve a uniform output power profile across the width of the web. For example, said heating means may comprise a plurality of individually controllable heating modules, arranged in an array across the width of the web path.

The apparatus according to the invention is advantageously an electrostatographic printer, wherein the surface member upon which the latent image is formed is a rotatable endless surface member such as an electrostatically chargeable photoconductive drum or belt and each imaging station contains, as an exposure source, an array of image-wise modulated light-emitting diodes. The apparatus is preferably also equipped with cutting means in order to cut the printed web into sheets. The cutting means is preferably positioned downstream of the image-fixing station.

The apparatus according to the invention may be a colour printer, containing a plurality of imaging stations each associated with a development and transfer station and the image-fixing station is located downstream of the last toner transfer station before cutting the printed web. When the printer is used as a colour printer, the development stations contain respectively cyan, magenta, yellow and optionally black toner particles.

The web of receptor material may be fed from a roll and the printer may be provided with means to move the web in synchronism with the circumferential speed to the surface members. Preferably, the web is arranged for movement in vertical direction through the printer and the imaging stations are located in staggered position with respect to the web.

The printer according to the invention may be a duplex colour printer which includes two sets of imaging, development and transfer stations, one set at each side of the web. In this preferred embodiment of the invention, the heating means may comprise two pairs of the housings articulated to move simultaneously between the open and closed positions, the housings being located one pair on each side of the web path. The invention is however equally applicable to a printer intended for simplex (i.e. one-sided) printing. Even in a simplex printer, there is an advantage in positioning heat sources on both sides of the web path, to apply radiant energy not only to that face of the web which carries the toner image but also to the reverse side thereof. Alternatively, a reflecting surface may be provided adjacent the reverse side of the web, to improve the efficiency of the fixing process.

We prefer that the image -fixing device described herein may be the only image-fixing device provided in the printer. It is however possible to provide a pre-fixing device upstream thereof, such as in the form of a hot roller or a pressure roller.

PREFERRED EMBODIMENTS OF THE INVENTION

The invention will now be further described, purely by way of example, with reference to the accompanying drawings, in which.

Figure 1:
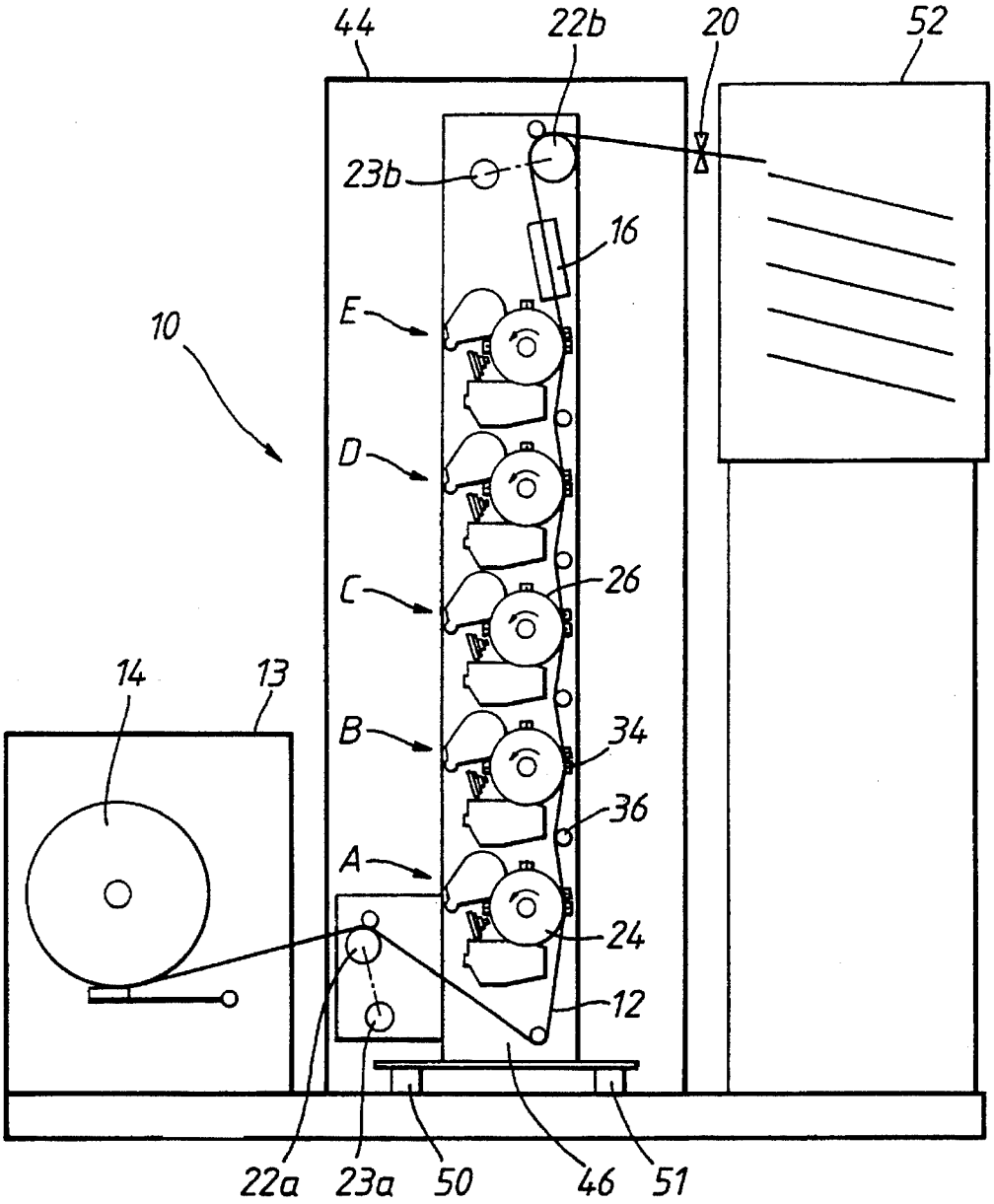
FIG. 1 illustrates a general set-up of a printer according to the invention, suitable for simplex printing.

Referring to FIG. 1, there is shown a printer having a supply station 13 in which a roll 14 of web material 12 is housed in sufficient quantity to print, say, 3 to 5,000 images. The web 12 is conveyed into a tower-like printer housing 44 in which a support column 46 is provided, housing five similar printing stations A to E. Printing stations A to D are provided to print cyan, magenta, yellow and black images respectively. In addition, a further station E is provided in order to optionally print an additional colour, for example a specially customised colour. The printing stations A to E are mounted in a substantially vertical configuration resulting in a reduced footprint of the printer and additionally making servicing easier. The column 46 may be mounted against vibrations by means of a platform 48 resting on springs 50, 51.

After leaving the final printing station E, the image on the web is fixed by means of the image-fixing station 16, details of which are described below. The web then passes to a cutting station 20 (schematically represented) and a stacker 52 if desired.

The web 12 is conveyed through the printer by two drive rollers 22*a*, 22*b* one positioned between the supply station 13 and the first printing station A and the second positioned between the image-fixing station 16 and the cutting station 20. The drive rollers 22*a*, 22*b* are driven by controllable motors, 23*a*, 23*b*. One of the motors 23*a*, 23*b* is speed controlled at such a rotational speed as to covey the web through the printer at the required speed, which may for example be about 125 mm/sec. The other motor is torque controlled in such a way as to generate a web tension of, for example, about 1 N/cm.

Figure 2:
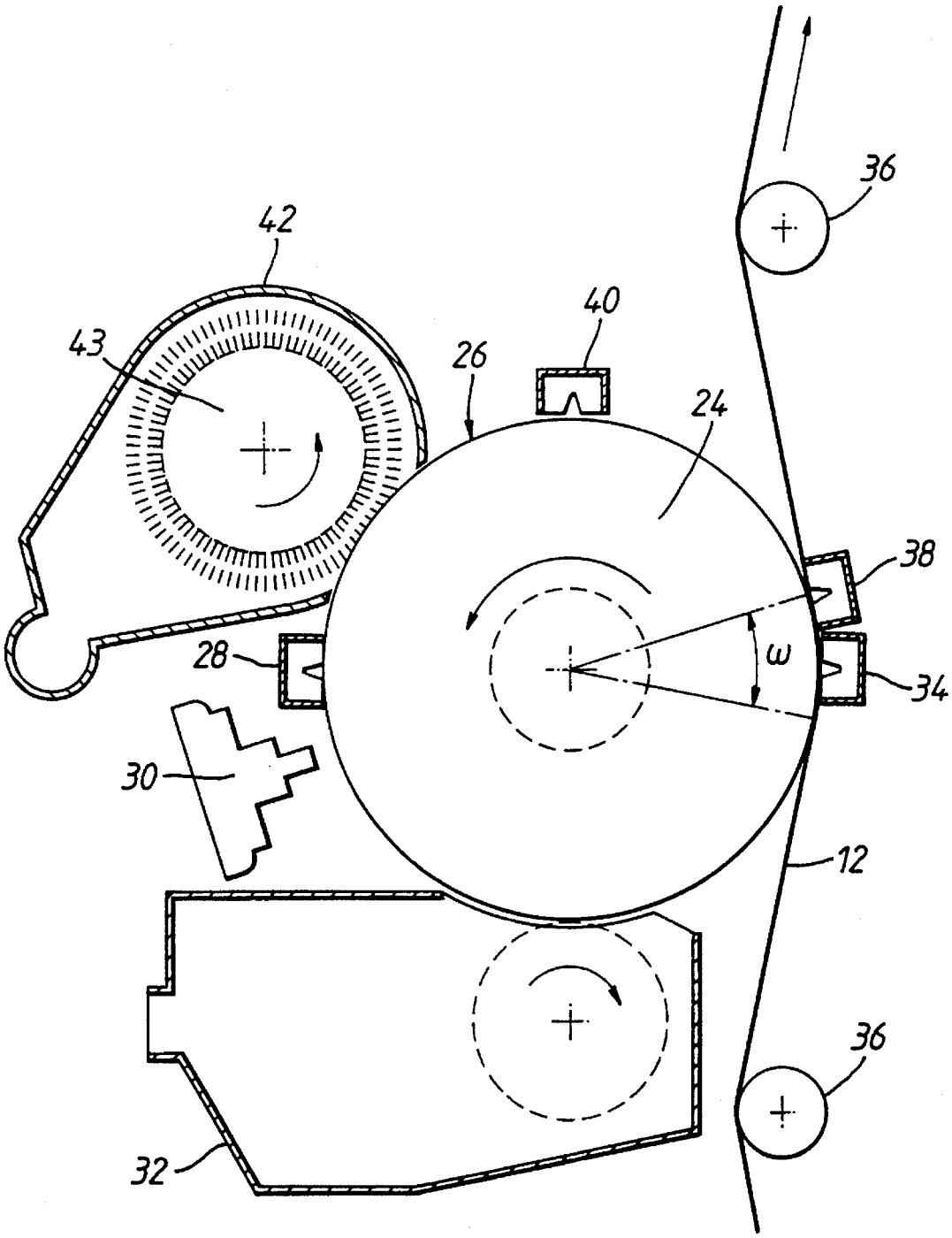
FIG. 2 shows in detail a cross-section of one of the print stations of the printer shown in FIG. 1.

As shown in FIG. 2, each printing station comprises a cylindrical drum 24 having a photoconductive outer surface 26. Circumferentially arranged around the drum 24 there is a main corotron or scorotron charging device 28 capable of uniformly charging the drum surface 26, for example to a potential of about −600 V, an exposure station 30 which may, for example, be in the form of a scanning laser beam or an LED array, which will image-wise and line-wise expose the photoconductive drum surface 26 causing the charge on the latter to be selectively dissipated, for example to a potential of about −250 V, leaving an image-wise distribution of electric charge to remain on the drum surface 26. This so-called "latent image" is rendered visible by a developing station 32 which by means known in the art will bring a developer in contact with the drum surface 26. The developing station 32 includes a developer drum 33 which is adjustably mounted, enabling it to be moved radially towards or away from the drum 24 for reasons as will be explained further below. According to one embodiment, the developer contains (i) toner particles containing a mixture of a resin, a dye or pigment of the appropriate colour and normally a charge-controlling compound giving triboelectric charge to the toner, and (ii) carrier particles charging the toner particles by frictional contact therewith. The carrier particles may be made of a magnetic material, such as iron or iron oxide. In a typical construction of a developer station, the developer drum 33 contains magnets carried within a rotating sleeve causing the mixture of toner and magnetic material to rotate therewith, to contact the surface 26 of the drum 24 in a brush-like manner. The toner particles are charged to a charge level of, for example 7–9 μC/g and are attracted to the latent image on the drum surface 26 by the electric field between the drum surface and the developer so that the latent image becomes visible.

After development, the toner image adhering to the drum surface 26 is transferred to the moving web 12 by a transfer corona device 34. The moving web 12 is in face-to-face contact with the drum surface 26 over a wrapping angle ω of about 15° determined by the position of guide rollers 36. The transfer corona device, being on the opposite side of the web to the drum, and having a high potential opposite in sign to that of the charge on the toner particles, attracts the toner particles away from the drum surface 26 and onto the surface of the web 12. The transfer corona device typically has its corona wire positioned about 7 mm from the housing which surrounds it and 7 mm from the paper web. A typical transfer corona current is about ±3 μA/cm. The transfer corona device 34 also serves to generate a strong adherent force between the web 12 and the drum surface 26, causing the latter to be rotated in synchronism with the movement of the web 12 and urging the toner particles into firm contact with the surface of the web 12. The web, however, should not wrap around the drum beyond the point dictated by the positioning of a guide roller 36 and there is therefore provided circumferentially beyond the transfer corona device 34 a web discharge corona device 38 driven by alternating current and serving to discharge the web 12 and thereby allow the web to become released from the drum surface 26. The web discharge corona device 38 also serves to eliminate sparking as the web leaves the surface 26 of the drum.

Thereafter, the drum surface 26 is pre-charged to an intermediate level of, for example −580 V, by a scorotron pre-cleaning corona device 40, causing any residual toner which might still cling to its surface to become loosened so that it may be collected at a cleaning unit 42 known in the art. The cleaning unit 42 includes an adjustably mounted cleaning brush 43, the position of which can be adjusted towards or away from the drum surface 26 to ensure optimum cleaning. The cleaning brush is earthed or subject to such a potential with respect to the drum as to attract the residual toner particles away from the drum surface. After cleaning, the drum surface is ready for another recording cycle.

After passing the first printing station A, as described above, the web passes successively to printing stations B, C, D and E, where images in other colours are transferred to the web. It is critical that the images produced in successive stations be in register with each other. In order to achieve this, the start of the imaging process at each station has to be critically timed. However, accurate registering of the images is possible only if there is no slip between the web 12 and the drum surface 26.

The electrostatic adherent force between the web and the drum generated by the transfer corona device 34, the wrapping angle ω determined by the relative position of the drum 24 and the guide rollers 36, and the tension in the web generated by the drive roller 22 and the braking effect of the brake 11 are such as to ensure that the rotational speed of the drum 24 is determined substantially only by the movement of the web 12, thereby ensuring that the drum surface moves synchronously with the web.

The cleaning unit 42 includes a rotatable cleaning brush 43 which is driven to rotate in a direction opposite to that of the drum 24 and at a peripheral speed of, for example twice the peripheral speed of the drum surface. The developing unit 32 includes a brush-like developer drum 33 which rotates in the same direction as the drum 24. The resultant rotational force applied to the drum 24 by the rotating developing brush 33 and the counter-rotating cleaning brush 43 is close to zero, thereby ensuring that the only rotational torque applied to the drum is derived from the adherent force between the drum 24 and the web 12. Adjustment of this resultant force is possible by virtue of the adjustable mounting of the developing brush 33 and the brush characteristics.

Figure 3:
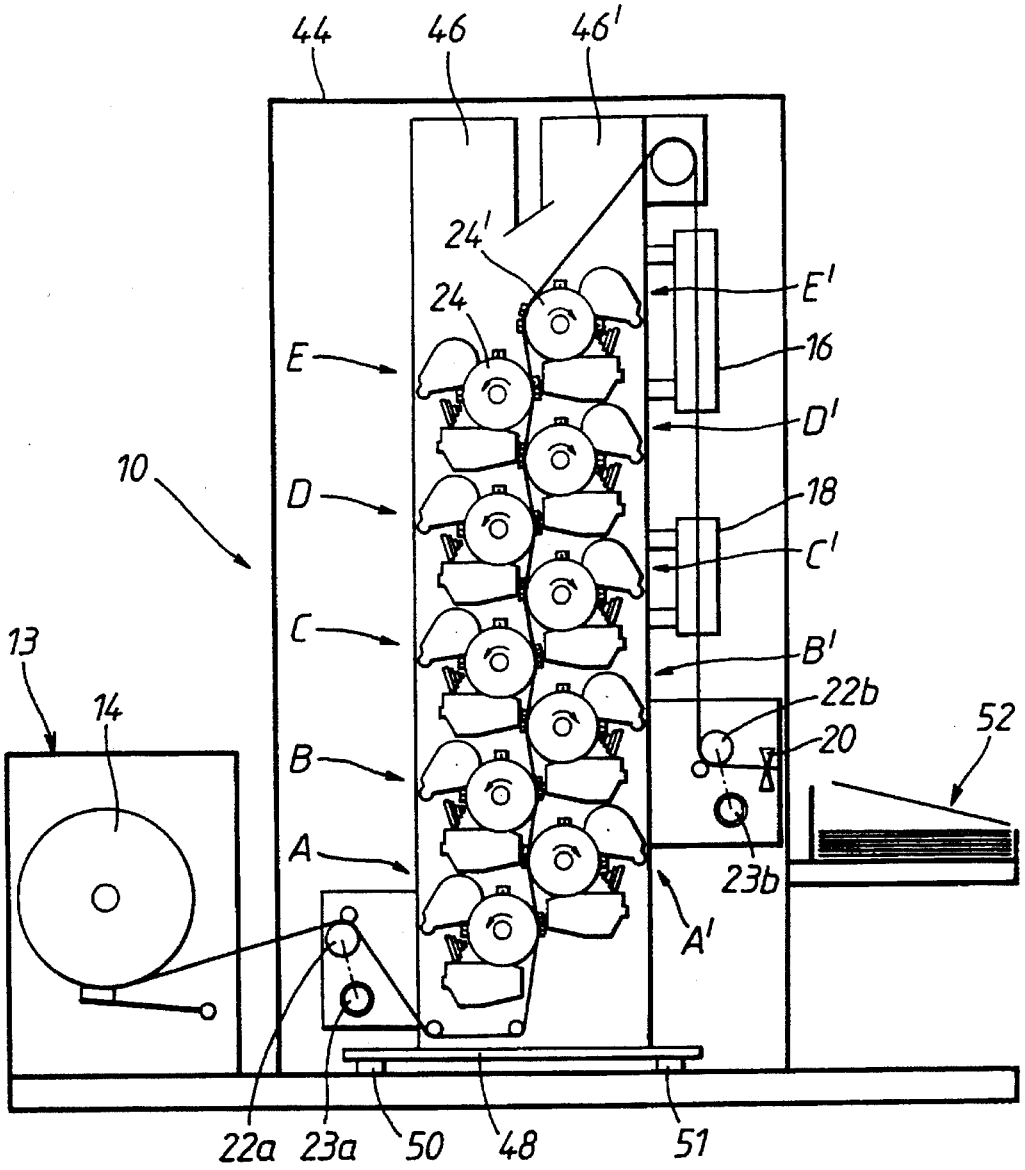
FIG. 3 shows a section of a printer according to an alternative embodiment of the invention, capable of simultaneous duplex printing.

In FIG. 3 there is shown a duplex printer which differs from the printer shown in FIG. 1 in that there are two support columns 46 and 46', housing printing stations A to E, and A' to E' respectively. The columns 46 and 46' are mounted closely together so that the web 12 travels in a generally vertical path defined by the facing surfaces of the imaging station drums 24, 24'. This arrangement is such that each imaging station drum acts as the guide roller for each adjacent drum by defining the wrapping angle.

FIGS. 4A to 4D show the structure and working principle of a preferred embodiment of the image-fixing unit 16 of FIGS. 1 and 3.

The image-fixing unit 16 comprises two pairs of hingedly coupled heat shielding housings 80, 81, 82 and 83, located a small distance apart, defining a space through which the web 12 can pass.

The housings 80 to 83 house radiation panels 92, which are preferably of the ceramic type and which radiate infrared radiation onto the web 12. This radiation is absorbed by the paper thereby heating the latter. Heat energy is then transferred by conduction from the web to the toners present on the web. The toners are also heated to some degree by convection of the hot air between the radiation panels and the web and to some extent also by adsorption of the radiated heat energy by the polymers present in the toner. The heated toners melt and become fixed to the web. A suitable radiant panel is the HFS-400 Watt radiation element marketed by Elstein-Werk, Germany. Such a radiant panel has a peak energy output wavelength of about 3.7 μm at 510° C.

The hingedly coupled heat shielding housings 80 to 83 are linked with each other by means of a cable 85 attached to a fixing point 84 on one of the housings 82. The fixing point 84 is located on one of the lower housings, 83, at a point adjacent that end thereof which is hinged to the upper housing 82 on that side of the web 12. From the fixing point 84, the cable 85 passes over a first pulley 86 located close to the point where the housings 80 and 81 on the other side of the web are hinged together. From the first pulley 86 the cable passes over a second pulley 89 located close to the articulation point of the upper housings 80 and 82 and in the plane of the web 12. The pulley then extends over an upper third pulley 87 to be connected at its other end to a drive roller 88 by means of which the heat shielding housings 80 to 83 may be brought from a closed position (FIG. 4A) to an open position (FIG. 4D) against the force of return springs (not shown). The drive roller 88 is driven by a DC motor 93 via a releasable coupling 94. The releasable coupling 94 is of the solenoid electrically operated type, so arranged that loss of electrical power thereto causes the coupling to adopt its released mode. Sensing means (not shown) are provided to continuously sense the movement of the paper web. The sensing means are associated with logic circuitry capable of cutting the electrical power to the releasable coupling 94 when the speed of movement of the paper web falls below a predetermined value, such as for example below 100 mm/sec. If the speed of the web should fall below this value, for example because of a failure of power to the web drive of the printer, the coupling 94 will adopt its released mode, enabling free rotation of the drive roller 88. Due to the force of the return springs (not shown) and thereafter under their own weight, the shielding housings 80 to 83 then fall into the closed position shown in FIG. 4A. The drive roller 88 carries a further cable 95 fixed at its other end to the piston 90 of a piston and cylinder damping device 91.

Figure 4A:
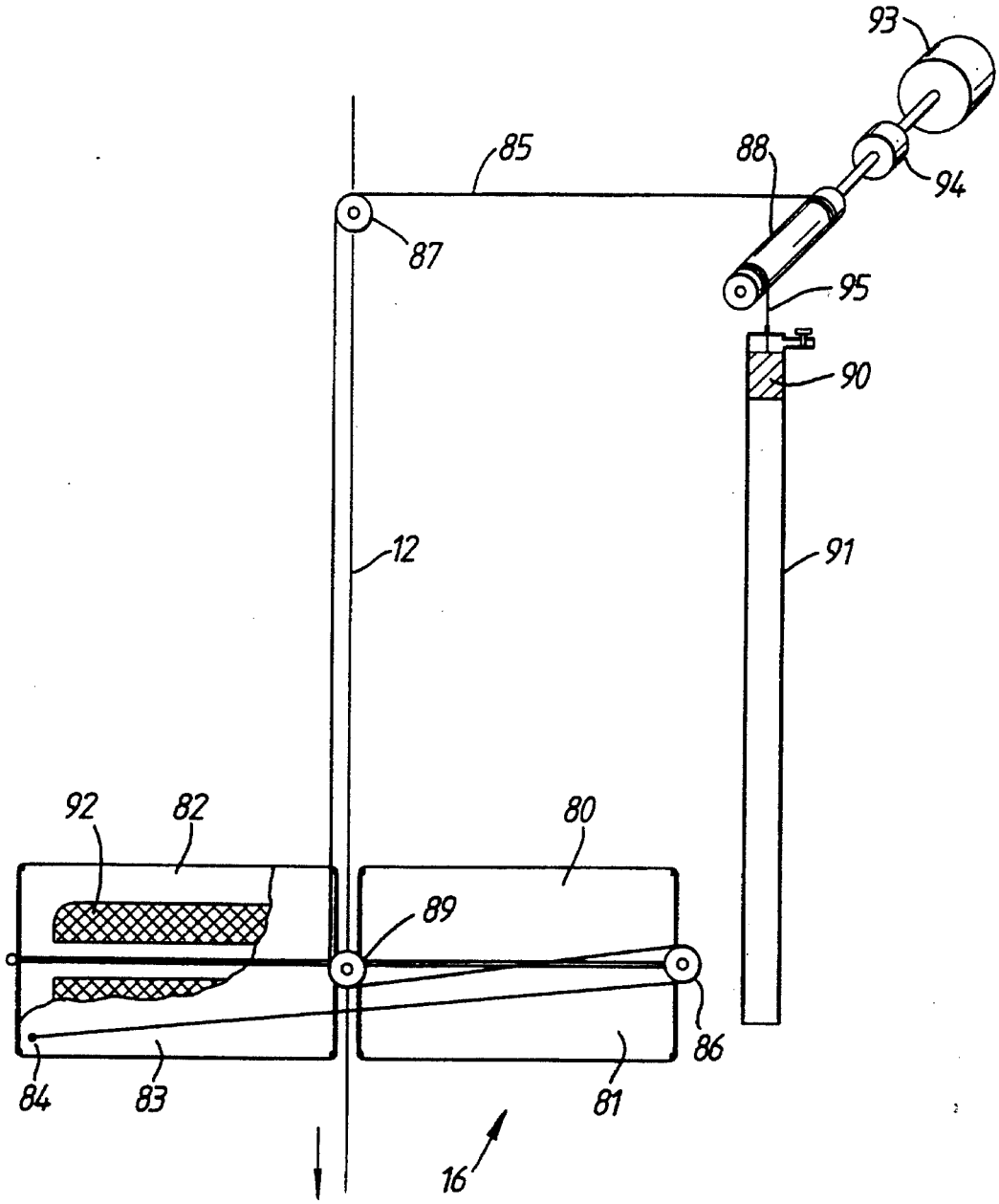
FIGS. 4A to 4D show views of the image-fixing station in operation.
Figure 4B:
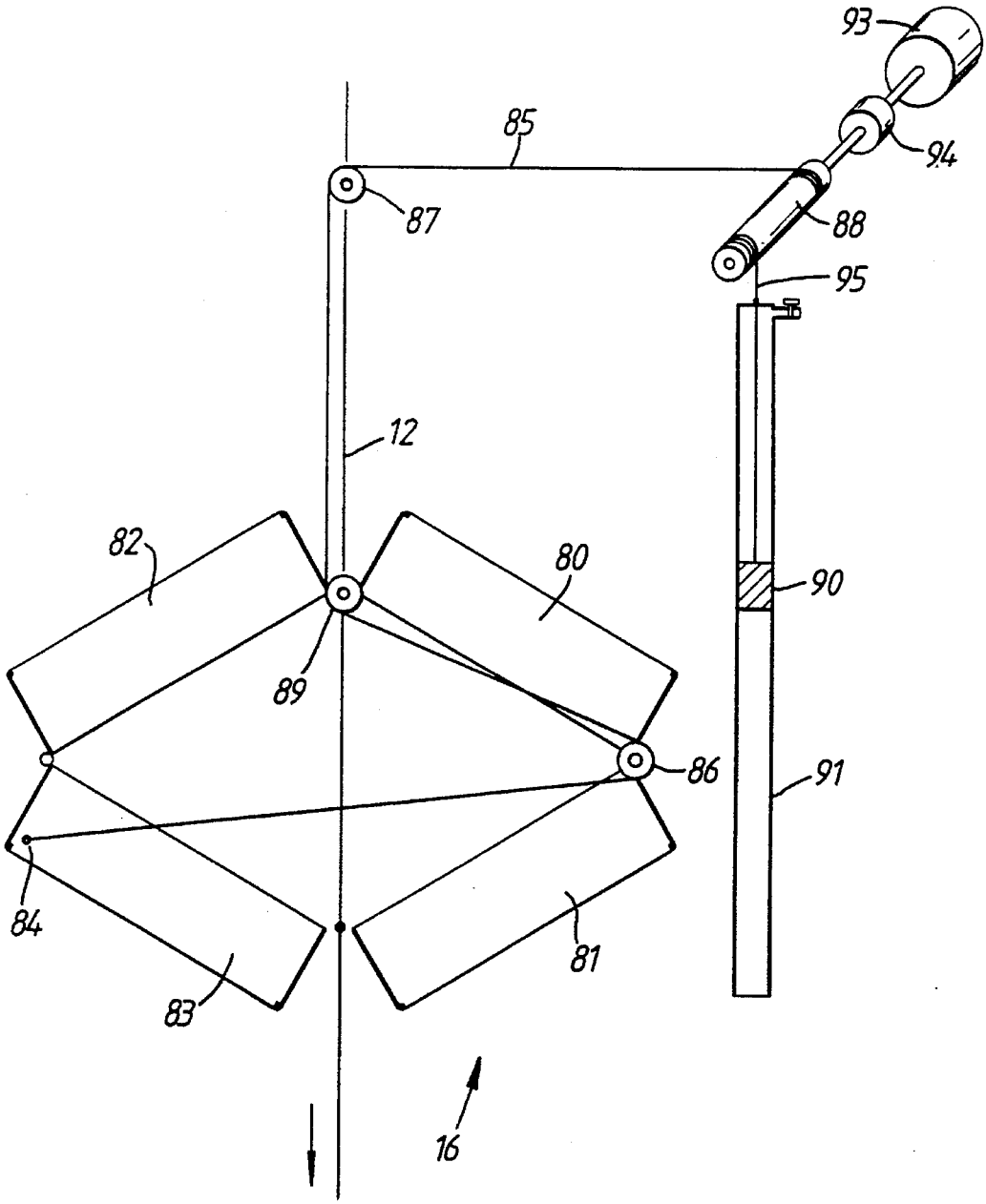
Figure 4C:
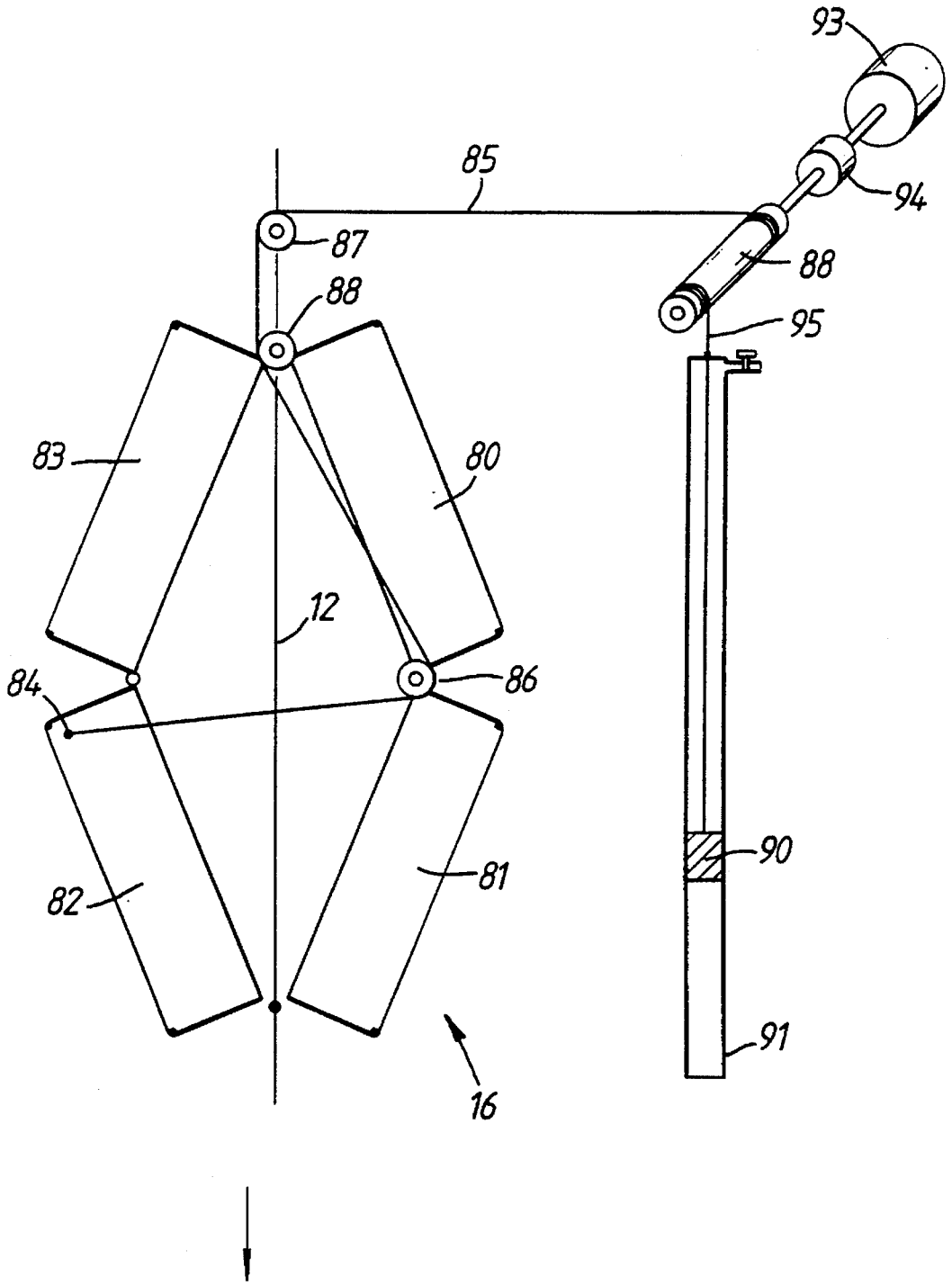
Figure 4D:
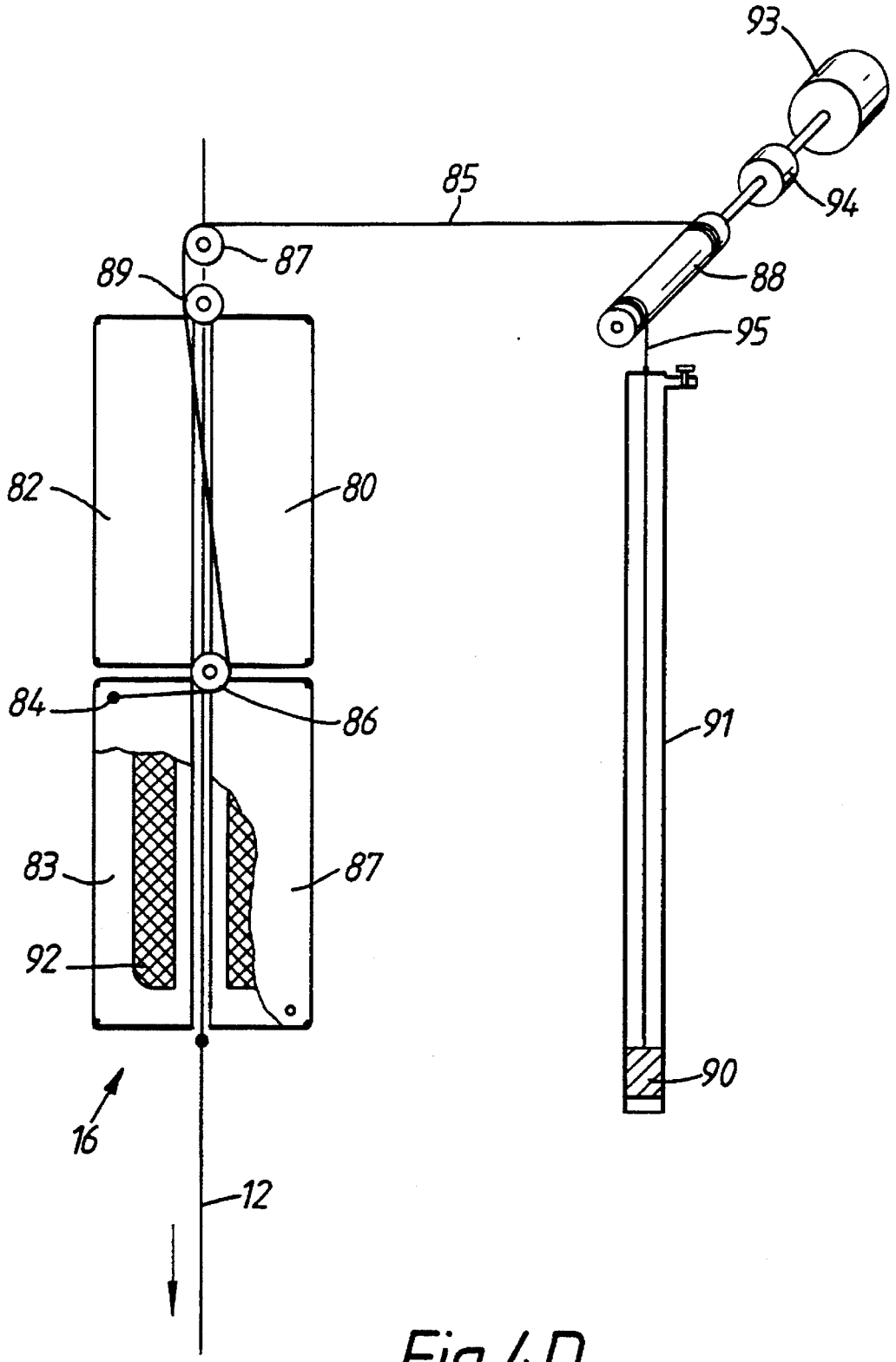

In the open position, shown in FIG. 4D, the radiation panels 92 are not shielded and supply radiation to the web 12 in order to heat the latter. In the closed position, shown in FIG. 4A, the radiation panels 92 are shielded by the shielding housings 80 to 83 (i.e. thermally isolated from the web 12), so that the web 12 is exposed to substantially no radiation therefrom. The closed position is taken during periods of warm-up or when the web is at a standstill. By allowing the radiant panels 92 to warm up with the shielding housings in the closed position, the warm-up period is thereby shortened. The open position is taken when the printer is working and toner has to be fixed.

Figure 5:
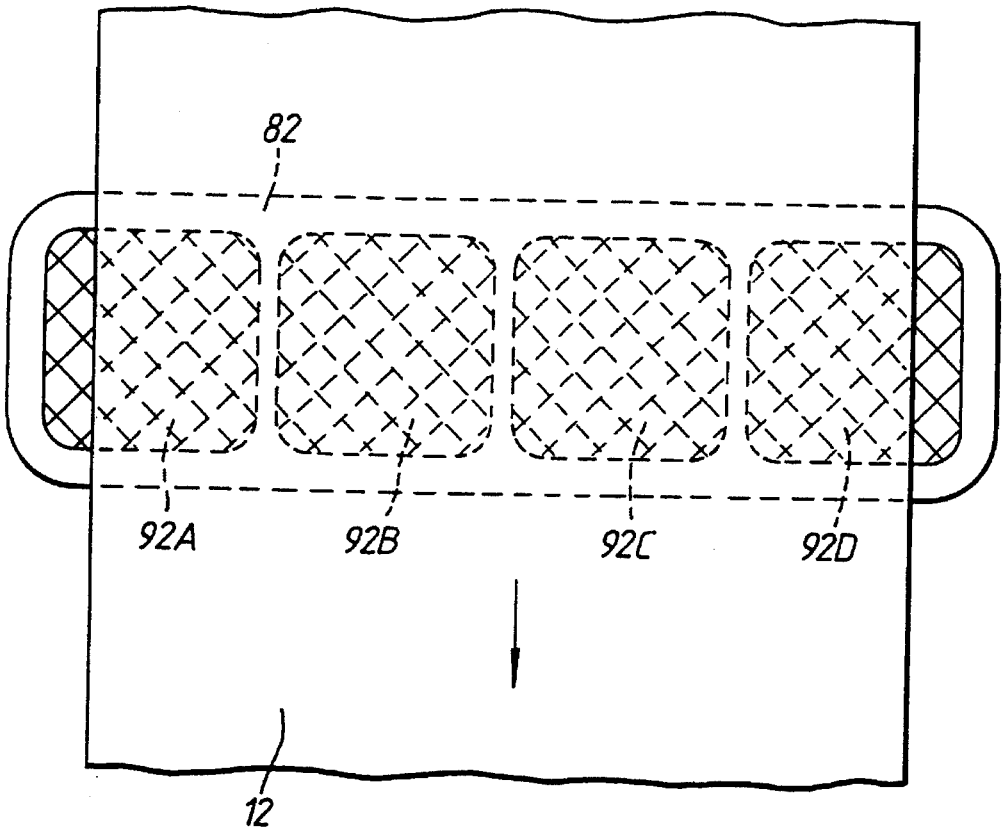
FIG. 5 shows a view of part of an image fixing station seen from the opposite side of the web.

As can be seen from FIG. 5, the radiation panel located in one of the housings 82 is made up of a number of, in this example four, individually controllable heating modules 92A, 92B, 92C and 92D, arranged in a linear array across the width of the web path, each of the outermost modules 92A and 92D extending somewhat beyond the respective edge of the web. Means (not shown), apparent to those skilled in the art, are provided to independently adjust the energy input to each of the modules 92A, 92B, 92C and 92D, thereby to control the heat output profile of the fixing device, in particular to provide a uniform heat output profile. The other radiation panels may be similarly constructed and controlled.

Figure 6A:
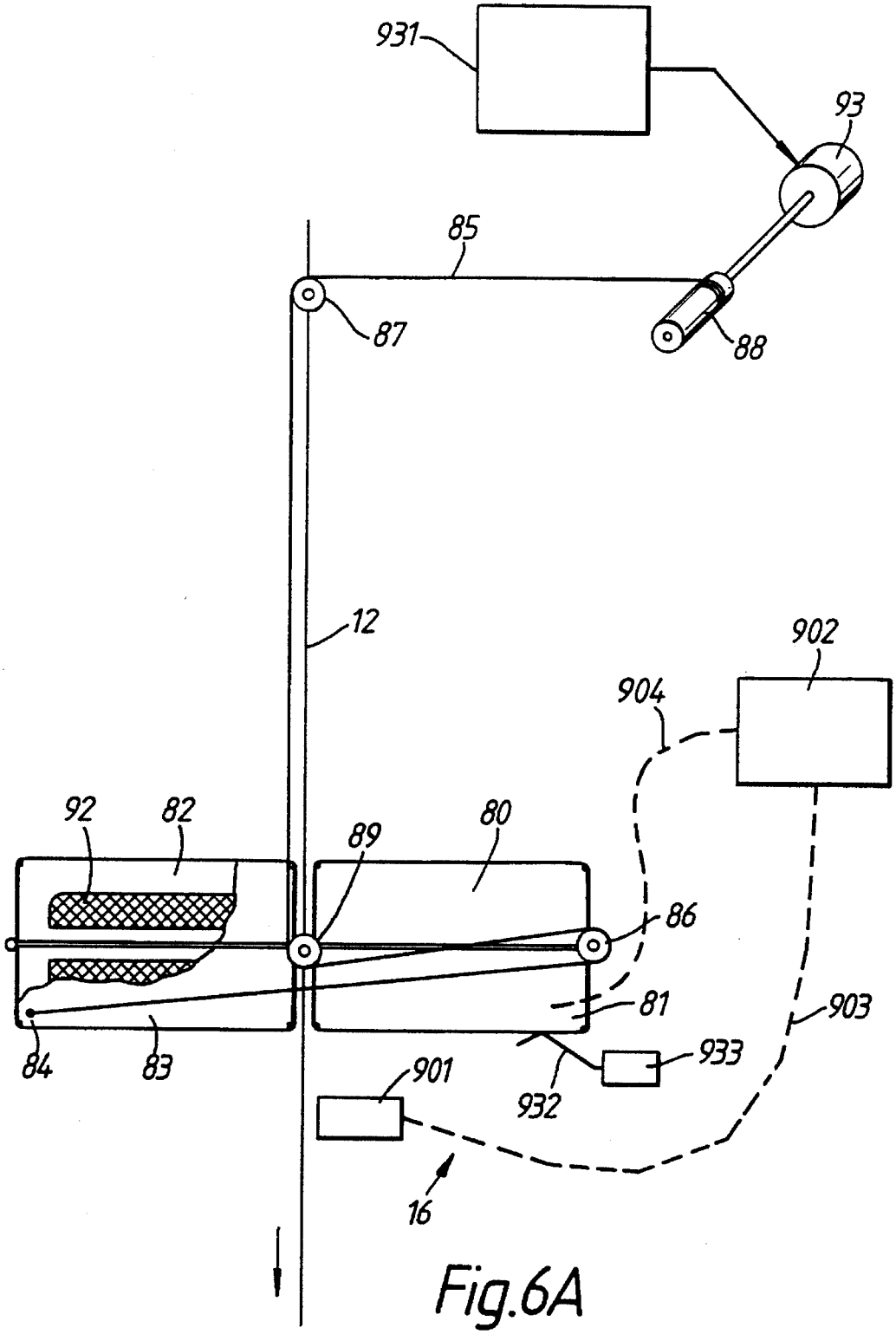
FIGS. 6A and 6B show an alternative embodiment of the fixing station according to the invention, in the closed and open positions respectively.
Figure 6B:
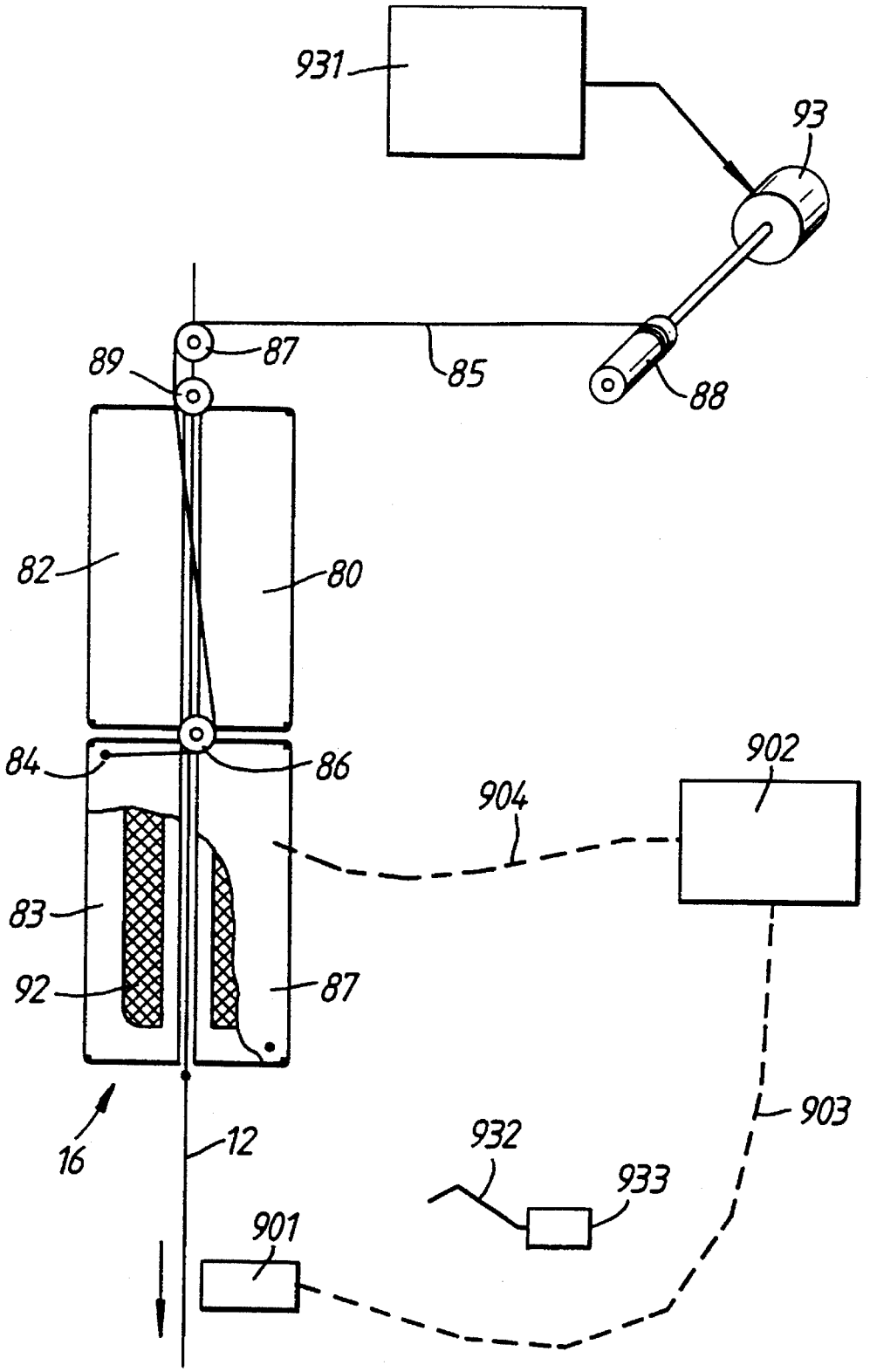

FIGS. 6A and 6B show the structure and working principle of an alternative embodiment of the image-fixing unit 16 of FIGS. 1 and 3.

In this embodiment, the drive roller 88 is driven by a DC motor 93 which is controlled by a control device 931. The control device 931 receives signals from the drive motors 23*a*, 23*b* which drive the web 12. The control device 931 is programmed such that so long as drive motors 23*a*, 23*b* are operational, power is supplied to the motor 93 to bring the fixing device 16 into its open operational position as shown in FIG. 6B. In the event that one or other of the drive motors 23*a*, 23*b* ceases to function as required, with the result that the speed of the web falls below the predetermined value, whether as a result of a power failure or other reason, power to motor 93 is cut, allowing the fixing device 16 to automatically return to the closed, inoperative position shown in FIG. 6A.

The control device 931 includes a brake circuit which acts to short-circuit the coils of the motor 93, when the fixing device moves into its non-operative closed position, thereby dispensing with the piston and cylinder device (90, 91) of the embodiment shown in FIGS. 4A to 4D. In this embodiment, the coupling (94) of FIGS. 4A to 4D is also dispensed with. The brake circuit of the control device 931 may include, in a manner well known in the art, a series set of diodes or a zener diode so arranged to ensure that current induced in the coils of the motor 93, as the pulley 88 rotates under the weight of the housings 80 to 83 as the fixing device moves to its closed position, is used to brake the motor.

A position sensor 933, having an operating lever 932 is positioned such as to be operated by the housing 81 of the fixing device when the fixing device is close to its closed position as shown in FIG. 6A. The switch is connected to the control device 931 by a line not shown in the Figure for the sake of clarity. The control device 931 responds to operation of the sensor 933 to exert a further braking action upon the motor 93 in the last few moments of movement of the fixing device 16.

The embodiment shown in FIGS. 6A and 6B also include an infra-red detector 901 positioned adjacent the web path downstream of the fixing device, to measure the temperature of the passing web. Signals from the detector 901 are fed via a line 903 to a control device 902, which is programmed to supply power via line 904 to the heating elements 92. In the operative position, the control device 902 controls the output of the heating elements 92 to supply an optimum level of radiation to the web to fix the image thereon. One or more further heat sensors (not shown) may be provided positioned on or adjacent the fixing device to feed signals to the control device 902 such that, in the non-operative position, the control device 902 keeps the heating elements at a predetermined stand-by temperature. In both the operative and non-operative positions, the heat output of the radiant sources 92 may be further controlled by the control device 902 in response to signals received from further heat sensors (not shown) positioned on or adjacent the radiant sources themselves.

CROSS-REFERENCE TO CO-PENDING APPLICATIONS

A number of features of the printers described herein are the subject matter of co-pending patent application Nos. 93304771.4 entitled "Electrostatographic single-pass multiple-station printer"; and 93304772.2 entitled "An electrostatographic single-pass multiple station printer for duplex printing", filed on Jun. 18 1993.

We claim:

1. An electrostatographic printer comprising:

(a) means for moving a web along a web path;

(b) an imaging station comprising means for forming a toner developable latent image on a surface member;

(c) a toner development station containing means for developing said latent image to form a toner image on said surface member;

(d) a toner transfer station positioned adjacent said web path comprising means for transferring said toner image from said surface member onto the web; and (e) an image-fixing station for fixing said toner image on said web, said image-fixing station being positioned adjacent and spaced from said web path downstream of said toner transfer station and including heating means comprising at least one radiant source having a peak energy output wavelength which is a non-visible wavelength, wherein said heating means further comprises two pairs of hingedly coupled heat-shielding housings within at least one of which a said radiant source is located, said heat-shielding housings being articulated to move simultaneously between an open position in which said web is exposed to said at least one radiant source to fix a toner image on said web, and a closed position in which said at least one radiant source is shielded by said heat-shielding housings from said web, said heat-shielding housings being located one pair on each side of said web path, said printer further comprising sensing means for sensing movement of said web and automatic control means to initiate shielding of said at least one radiant source from said web when a speed of movement of said web falls below a predetermined value.

2. An electrostatographic printer according to claim 1, wherein said radiant source is an infrared radiation emitting source.

3. An electrostatographic printer according to claim 2, wherein said at least one radiant source has a radiant energy output wavelength within a range of from 1 to 10 μm.

4. An electrostatographic printer according to claim 3, wherein said radiant source has a radiant energy output wavelength within the range of from 3 to 6 μm.

5. An electrostatographic printer according claim 1, wherein said image-fixing station further includes means for shielding said radiant source from said web when the speed of movement of said weld falls below a predetermined value.

6. An electrostatographic printer according to claim 1, wherein said radiant sources are located at opposite sides of said web path.

7. An electrostatographic printer according to claim 1, wherein means for moving said heat-shielding housings from said closed position to said open position comprises a cable connected between said heat-shielding housings and a cable drive device.

8. An electrostatographic printer according to claim 1, wherein said heat-shielding housings are moveable into said closed position under gravitational force.

9. An electrostatographic printer according to claim 1, wherein said apparatus contains a plurality of imaging stations, each imaging station having a development station and a transfer station; and wherein said image-fixing station is located downstream of said imaging stations and upstream of a web cutting station.

10. An electrostatographic printer according to claim 1, wherein the printer is a duplex colour printer having development stations located on each side of said web path, the development stations containing respectively cyan, magenta, yellow and black toner particles.

11. An electrostatographic printer according to claim 1, further comprising output power profile control means for controlling said heating means.

12. An electrostatographic printer according to claim 11, wherein said heating means comprises a plurality of individually controllable heating modules, arranged in an array across said web path.

13. A method of operating an electrostatographic printer including the steps of:

(a) moving a web material along a web path;

(b) forming a toner developable latent image on surface member at an imaging station;

(c) developing said latent image to form a toner image on said surface member at a toner development station;

(d) transferring said toner image from said surface member onto the web at a toner transfer station positioned adjacent said web path;

(e) fixing said toner image on said web at an image-fixing station positioned adjacent and spaced from said web path downstream of said toner transfer station, said image-fixing station including heating means comprising at least one radiant source having a peak energy output which is a non-visible wavelength, wherein said heating means further comprises two pairs of hingedly coupled heat-shielding housings within at least one of which a said radiant source is located, said heat-shielding housings being articulated for simultaneous movement between an open position in which said web is exposed to said at least one radiant source to fix a toner image on said web, and a closed position in which said at least one radiant source is shielded by said heat-shielding housings from said web, said heat-shielding housings being located one pair on each side of said web path; and (f) sensing movement of said web and automatically initiating the shielding of said radiant source from said web when a speed of movement of said web falls below a predetermined value.

14. A method according to claim 13, wherein the peak energy output wavelength of said radiant source corresponds to an absorption wavelength of said receptor material.

15. A method according to claim 14, wherein said web comprises paper.

* * * * *